US008289226B2

(12) United States Patent
Takach et al.

(10) Patent No.: US 8,289,226 B2
(45) Date of Patent: Oct. 16, 2012

(54) ANTENNA FOR A BUILDING CONTROLLER

(75) Inventors: Eugene J. Takach, Eden Prairie, MN (US); John S. Fultz, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 899 days.

(21) Appl. No.: 11/946,804

(22) Filed: Nov. 28, 2007

(65) Prior Publication Data

US 2009/0138124 A1 May 28, 2009

(51) Int. Cl.
*H01Q 1/00* (2006.01)
*H01P 11/00* (2006.01)

(52) U.S. Cl. ..... 343/907; 29/600

(58) Field of Classification Search ..... 343/700 MS, 343/741, 742, 907; 29/600, 601
See application file for complete search history.

(56) References Cited

U.S. PATENT DOCUMENTS

| | | | | |
|---|---|---|---|---|
| 5,483,249 | A | 1/1996 | Kennedy | |
| 5,581,262 | A | 12/1996 | Kawahata et al. | |
| 5,867,126 | A | 2/1999 | Kawahata et al. | |
| 5,900,845 | A | 5/1999 | Mandai et al. | |
| 6,011,517 | A | 1/2000 | Skurski | |
| 6,051,781 | A | 4/2000 | Bianca et al. | |
| 6,133,886 | A * | 10/2000 | Fariello et al. | 343/702 |
| 6,326,922 | B1 | 12/2001 | Hegendoerfer | |
| 6,693,593 | B1 | 2/2004 | Burgess | |
| 6,850,197 | B2 * | 2/2005 | Paun | 343/702 |
| 7,050,003 | B2 * | 5/2006 | Sievenpiper | 343/700 MS |
| 7,085,139 | B2 | 8/2006 | Chen | |
| 7,170,453 | B2 * | 1/2007 | Noguchi et al. | 343/702 |
| 7,196,667 | B2 | 3/2007 | Watada et al. | |
| 7,389,920 | B2 * | 6/2008 | Rodgers | 235/385 |
| 7,701,399 | B2 * | 4/2010 | Aoyama et al. | 343/702 |
| 8,051,550 | B2 * | 11/2011 | Cheng et al. | 29/600 |
| 2005/0040943 | A1 | 2/2005 | Winick | |
| 2005/0243001 | A1 | 11/2005 | Miyata et al. | |
| 2005/0270151 | A1 * | 12/2005 | Winick | 340/539.1 |

OTHER PUBLICATIONS

Fairchild Semiconductor, Surface Mount Tape and Reel, Specification, 20 pages, Apr. 1998.
GE, "Model CC-SCSTAT SmartCommand Thermostat," 4 pages, Sep. 2007.
RCS, "Application Note 8, RS232/485 Network Wiring: Guide to Installing RCS HVAC Controls," 6 pages, Dec. 2005.

* cited by examiner

*Primary Examiner* — Jacob Y Choi
*Assistant Examiner* — Robert Karacsony
(74) *Attorney, Agent, or Firm* — Seager Tufte & Wickhem LLC.

(57) ABSTRACT

The present invention relates generally to building controllers, and more particularly, to antennas for providing wireless communication capabilities in such building controllers. Methods and systems for automated surface mounting of such antennas are also contemplated and disclosed.

13 Claims, 15 Drawing Sheets

ANTENNA FOR A BUILDING CONTROLLER

FIELD

The present invention relates generally to building controllers, and more particularly, to antennas for providing wireless communication capabilities in building controllers.

BACKGROUND

Building control systems often include heating, ventilation, and/or air conditioning (HVAC) systems to control the comfort level within a building. Many building control systems include a controller that activates and deactivates one or more HVAC components of the HVAC system to affect and control one or more environmental conditions within the building. These environmental conditions can include, but are not limited to, temperature, humidity, and/or ventilation. In many cases, the controller of the building control system may include, or have access to, one or more sensors, and may use parameters provided by the one or more sensors to control the one or more HVAC components to achieve one or more programmed or set environmental conditions.

In some cases, the building controller may be a thermostat that is mounted to a wall or the like of the building. A typical thermostat includes a local temperature sensor and/or other sensors, which may be used to sense one or more environmental conditions of the inside space proximate to the thermostat. In some cases, the thermostat may have access to one or more remotely located sensors that, in some installations, are mounted to a wall or the like in the building at a location remote from the thermostat. In these installations, the sensors are typically mounted at or near the walls of the building, and at particular fixed locations within the building.

In some installations, the thermostat may be configured to wirelessly interact and/or communicate with the remotely located sensors or other devices (e.g. dampers, furnaces, boilers, or other HVAC components). In some situations, the thermostat may transmit and/or receive HVAC system control information to/from the remote sensor or other device. In some configurations, the thermostat, remotely located sensor, or other device may include an antenna to facilitate such wireless communication. When provided, an antenna is often manually mounted to the thermostat, remote sensor, or other device during device assembly. This, however, can have orientation issues, inconsistent interconnects, and can increase the cost of assembly. Alternatively, an antenna is sometimes printed on a printed circuit board of the thermostat or other device. This, however, does not have a three-dimensional configuration of the antenna, which may be advantageous in certain application. In both cases, the robustness and/or performance of the antenna can be limited. Therefore, there is a need for an improved antenna and method of mounting the antenna to a building controller, remote sensor, or other device.

SUMMARY

The present invention relates generally to building controllers, and more particularly, to antennas for providing wireless communication capabilities in such building controllers. Methods and systems for automated surface mounting of such antennas are also contemplated and disclosed.

BRIEF DESCRIPTION

The invention may be more completely understood in consideration of the following detailed description of various illustrative embodiments of the invention in connection with the accompanying drawings, in which.

DETAILED DESCRIPTION

Figure 1:
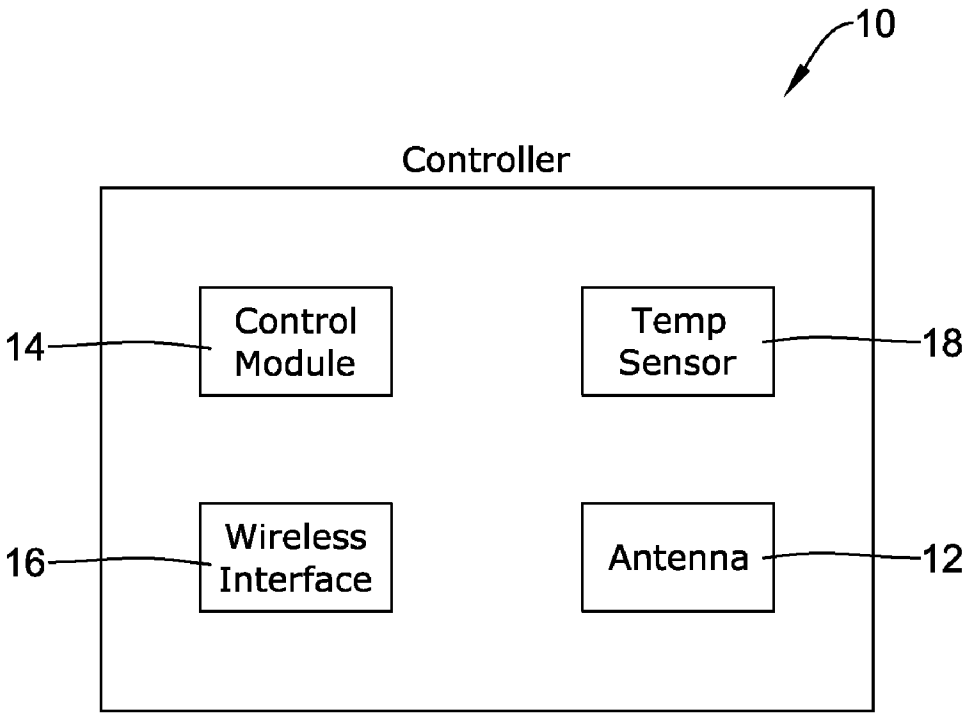
FIG. 1 is a block diagram of an illustrative heating, ventilation, and air conditioning (HVAC) controller for a building control system.

The following description should be read with reference to the drawings wherein like reference numerals indicate like elements throughout the several views. The detailed description and drawings show several embodiments which are meant to be illustrative of the claimed invention.

FIG. 1 is a block diagram of an illustrative heating, ventilation, and air conditioning (HVAC) controller 10 for a building control system for use in a building or structure, such as, for example, a commercial and/or residential building or structure. While many of the illustrative embodiments are presented in terms of an HVAC controller, it is contemplated that the present invention may be equally suitable for use with other types of building controllers including, for example, those that include alarm systems, fire detection systems, and/or other systems as desired.

In the illustrative embodiment, HVAC controller 10 may be operatively connected to one or more HVAC components (not shown) that can be activated to regulate one or more environmental conditions such as temperature, humidity, ventilation, and/or air quality levels within a building or other structure. Example HVAC components may include, but are not limited to, remote sensors, cooling units (i.e. air conditioners), heating units (i.e. boilers, furnaces, etc.), filtration units, dampers, valves, humidifier/dehumidifier units, and/or ventilation units (i.e. fans, blowers, etc.). In some cases, HVAC controller 10 may be a thermostat, such as, for example, a wall mountable thermostat, if desired. In other cases, HVAC controller 10 may be a control unit that does not include a local temperature sensor, but rather relies on temperature measurements taken by one or more remotely located sensors.

In some cases, the HVAC controller may be a remote controller that provides remote control and/or sensing for the building control system. In some cases, the remote controller may be a portable remote control unit that may be operatively connected to a thermostat or other building controller. When so provided, the remote controller may be movable between multiple locations within a building or structure by a user. For example, in a residential building, a user may carry the remote controller between a living room, a kitchen, a den, a bedroom, and/or any other location in the residential building. The remote controller may sense an ambient temperature adjacent to the remote controller and, in some cases, relay the temperature to a thermostat or other building controller. In any event, it is contemplated that HVAC controller 10 may be any suitable HVAC controller, as desired.

In the illustrative embodiment of FIG. 1, the HVAC controller 10 includes a control module 14, a temperature sensor 18, a wireless interface 16, and an antenna 12. Temperature sensor 18 may sense the temperature proximate to the HVAC controller 10. As illustrated, temperature sensor 18 may be included with the HVAC controller 10, such as within the housing of HVAC controller 10. However, it is contemplated that temperature sensor 18 may be located remote from the HVAC controller 10, but in communication therewith.

Control module 14 of HVAC controller 10 may be configured to control the comfort level of at least a portion of the building or structure by activating and/or deactivating one or more HVAC components. In some cases, control module 14 may be configured to control one or more HVAC functions, such as, for example, HVAC schedules, temperature setpoints, humidity setpoints, trend logs, timers, environment sensing, and/or other HVAC functions, as desired. In the illustrative embodiment, control module 14 may selectively control the comfort level of at least a portion of the building or structure using the temperature sensed by temperature sensor 18 and/or, if provided, a temperature sensed by a temperature sensor located remote from the HVAC controller 10.

Wireless interface 16 of HVAC controller 10 may be configured to wirelessly communicate (i.e. transmit and/or receive signals) with one or more HVAC components or devices in the building control system. The wireless interface 16 may include, for example, a radio frequency (RF) wireless interface, an infrared wireless interface, a microwave wireless interface, an optical interface, and/or any other suitable wireless interface, as desired. Wireless interface 16 may be coupled to the control module 14 to provide communication between the control module 14 and one or more HVAC components or devices in the building control system.

Antenna 12 of the HVAC controller 10 may be coupled to wireless interface 16 to transmit and/or receive wireless signals. For example, antenna 12 may convert electrical currents received from the wireless interface 16 into electromagnetic waves, generating an electromagnetic field, which can be transmitted to other HVAC components and/or devices. Antenna 12 may also convert electromagnetic waves received from other HVAC components and/or devices into electrical currents, and relay these currents to wireless interface 16.

Antenna 12 may be configured to operate in the radio frequency (RF) range, the microwave range, and/or any other suitable frequency range, as desired. In one example, when antenna 20 is configured to operate in the radio frequency range, antenna 20 may include an operating frequency range that may have a peak operating wavelength, and antenna 20 may have an effective length of about one-half of the peak operating wavelength. More generally, and in some embodiments, antenna 20 may have an effective length of about 1/N of the wavelength of the peak operating wavelength, where N is an integer greater than zero, such as, for example, 1, 2, 3, 4, 5, 10, etc.

It should be recognized that HVAC controller 10 of FIG. 1 is merely illustrative and is not meant to be limiting in any manner. It is to be understood that the HVAC controller 10 may be any suitable controller, as desired. In some cases, it is contemplated that the HVAC controller 10 may include a user interface that may allow a user or technician to program and/or modify one or more control parameters of HVAC controller 10, such as programming and/or schedule parameters, if desired. In this case, the user interface may include a touch screen, a liquid crystal display (LCD) panel and keypad, a dot matrix display, a computer, one or more buttons, a communications port, and/or any other suitable interface, as desired. Furthermore, it is contemplated that antenna 20 may be incorporated in any suitable device having wireless communication capabilities, such as, for example, temperature sensors, humidity sensors, airflow sensors, VOC sensors, zone controllers, or any other suitable device, as desired.

Figure 2:
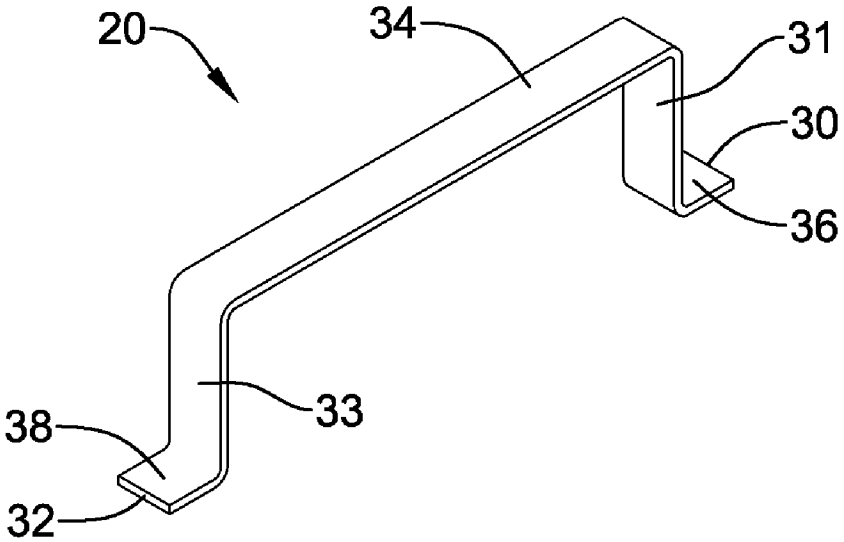
FIG. 2 is a perspective view of an illustrative antenna in accordance with the present invention.
Figure 3:
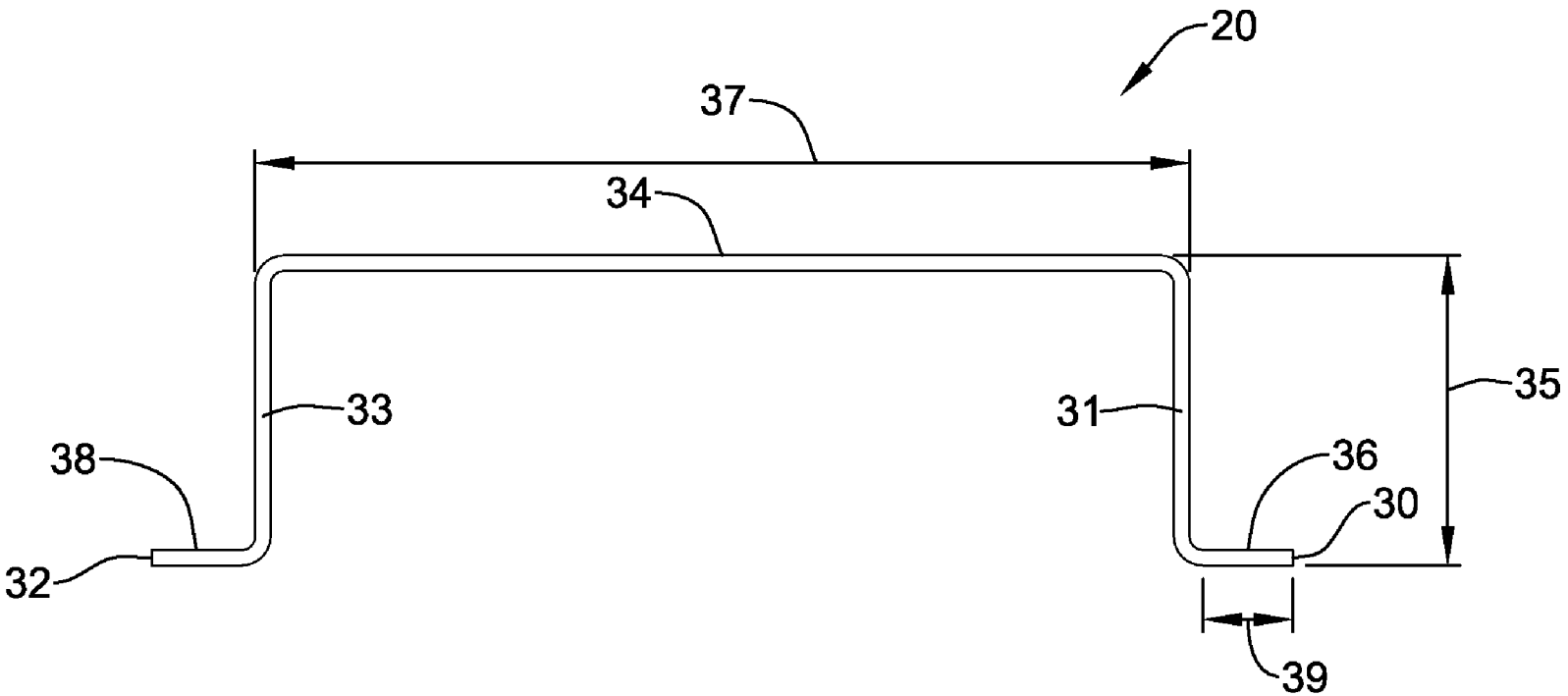
FIG. 3 is side view of the illustrative antenna of FIG. 2.
Figure 4:
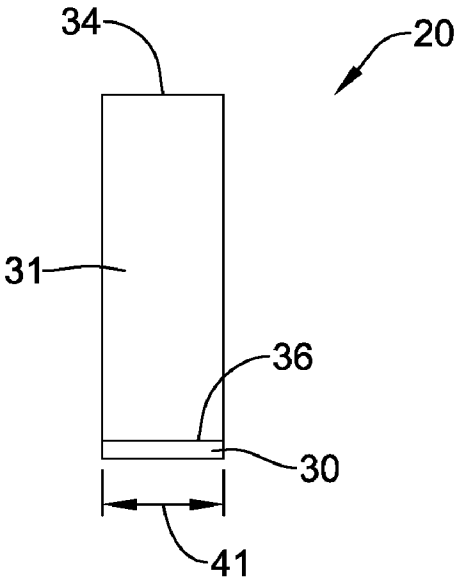
FIG. 4 is an end view of the illustrative antenna of FIG. 2.

FIGS. 2-4 show various views of an illustrative antenna 20 in accordance with one illustrative embodiment of the present invention. In the illustrative embodiment, the antenna 20 includes a first foot 36, a second foot 38, and an intermediate portion 34 therebetween. As illustrated, foot 36 may be adjacent to a first end 30 of antenna 20 and foot 38 may be adjacent to a second end 32 of antenna 20. In the illustrative embodiment, foot 36 and foot 38 may be generally rectangular in shape, but this is not required. For example, foot 36 and foot 38 may be square, round or any other suitable shape, as desired. Foot 36 and foot 38 may be configured and shaped to be mounted to a printed circuit board (see, for example, FIG. 7) to provide an electrical connection between the antenna and wireless interface 16 of the HVAC controller 10. In some cases, as will be discussed in further detail, foot 36 and foot 38 may be surface mounted to the printed circuit board and secured with solder.

Intermediate portion 34 of antenna 20 may be configured to be spaced from the printed circuit board when mounted to the printed circuit board. To accomplish this, intermediate portion 34 may include generally vertical portions 31 and 33. Vertical portion 31 may be provided adjacent to foot 36 and may extend at an angle therefrom. In some cases, vertical portion 31 may extend at an angle in the range of 70 degrees to 90 degrees from foot 36, but other angles are also contemplated. Similarly, vertical portion 33 may be provided adjacent to foot 38 and may extend at an angle therefrom. In some cases, vertical portion 33 may extend at an angle in the range of 70 degrees to 90 degrees from foot 38, but other angles are also contemplated. The remainder of intermediate portion 34, between the two vertical portions 31 and 33, may be generally parallel to feet 36 and 38. In other words, intermediate portion, including vertical portion 31 and 33, is generally U-shaped in the illustrative embodiment.

As illustrated in FIG. 3, antenna 20 may configured to have a height 35 and a length 37. In some cases, the height 35 of antenna 20 may be in the range of 0.1 inches to 1 inch. However, it is contemplated that any suitable height may be used, as desired. In some cases, the length 37 of antenna 20 may be in the range of 0.5 inches to 2 inches. However, it is contemplated that any suitable length may be used, depending on the desired antenna frequency and application. In one example, antenna 20 may be configured to have a height 35 of 0.4 inches and a length 37 of 1.4 inches. In another example, antenna 20 may be configured to have a height 35 of 0.25 inches and a length 37 of 0.875 inches. In yet another example, antenna 20 may be configured to have a height 35 of 0.3 inches and a length 37 of 0.75 inches. These examples are merely illustrative and are not meant to be limiting in any way. It is to be understood that any suitable height 35 and length 37 of antenna 20 may be used, as desired.

Additionally, as illustrated in FIG. 3, feet 36 and 38 of antenna 20 may have a length. The length of the feet 36 and 38 may be any suitable length to provide a secure electrical connection to the printed circuit board, as desired. In one example, the length of feet 36 and 38 may be 0.1 inches. However, any suitable length and width may be used, as desired.

In the illustrative embodiment, antenna 20 may be configured to have a width 41, as illustrated in FIG. 4. The width 41 of antenna 20 may be in the range of 0.05 inches to 0.5 inches. In one example, the width 41 of the antenna 20 may be about 0.1 inches. However, it is contemplated that any suitable width may be used, as desired. Furthermore, as illustrated in FIG. 4, the width of feet 36 and 38 may be about the same width as the intermediate portion 34 of antenna 20, but this is not required.

In the illustrative embodiment, antenna 20 may include a suitable material to generate electromagnetic waves based upon an input current, such as, for example, brass, copper, or any other suitable material, as desired. In some cases, antenna 20 may also be plated with a second material, such as, for example, tin, silver, gold, copper, or any other suitable plating material, as desired. In an example embodiment of a brass, tin-plated antenna, the brass may be configured to have a thickness and the tin-plating may have a thickness. In one example, the brass may be about 0.015 inches thick and the tin-plating may have a thickness of about 100 micro-inches or more. However, it is to be understood that any suitable materials and/or material thicknesses may be used, as desired.

Figure 5:
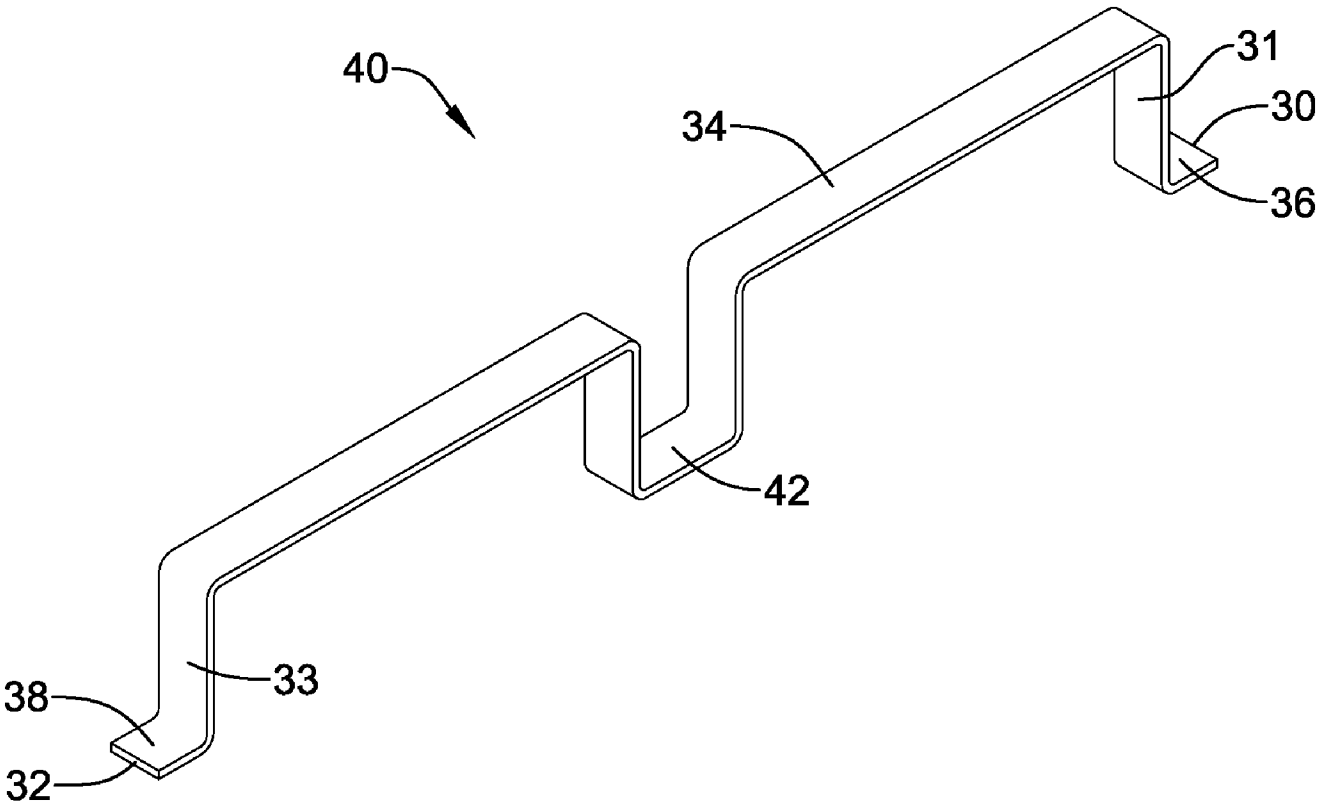
FIG. 5 is a perspective view of another illustrative antenna having a downward extending portion.

FIG. 5 is a perspective view of another illustrative antenna 40. Antenna 40 is similar to antenna 20 previously described, except that intermediate portion 34 includes a downward extending portion 42, or intermediate foot-like portion. In some cases, portion 42 may be configured to be adjacent to the printed circuit board, and may be mounted to the printed circuit board, similar to feet 36 and 38, but this is not required.

In the illustrative embodiment of FIG. 5, portion 42 is depicted in the longitudinal center of intermediate portion 34. However, it is contemplated that portion 42 may be offset towards either end 30 or end 32, as desired. In some cases, portion 42 may add more structural rigidity to the antenna 40, such as, for example, in antennas having a relatively longer length.

Figure 6:
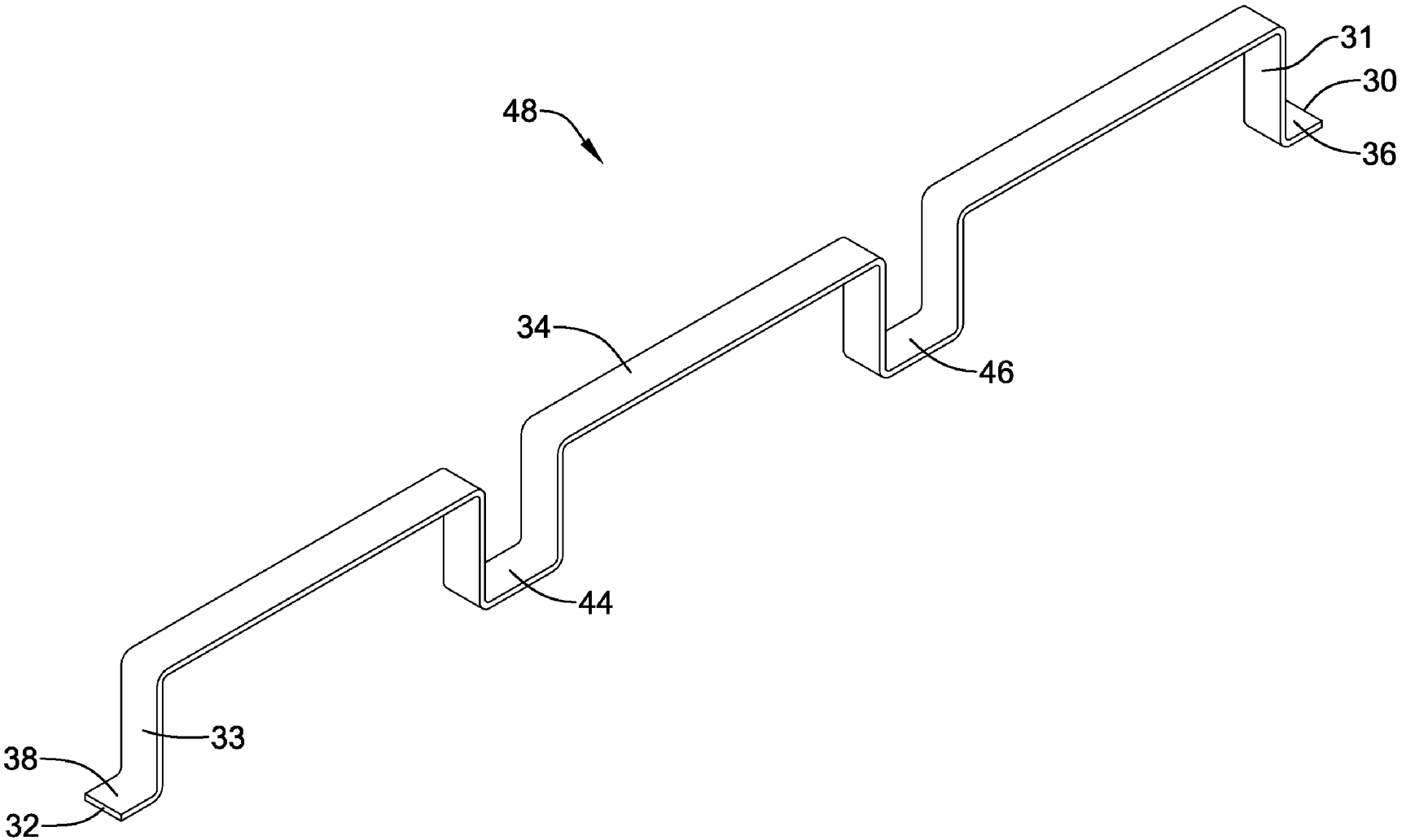
FIG. 6 is a perspective view of another illustrative antenna having multiple downward extending portions.

FIG. 6 is a perspective view of another illustrative antenna 48 having multiple downward extending portions 44 and 46. The illustrative antenna 48 is similar to the antenna 40 of FIG. 5, except that antenna 48 includes two downward extending portions 44 and 46, instead of only one. It is contemplated that the antenna may include any number of downward extending portions, as desired.

Figure 7:
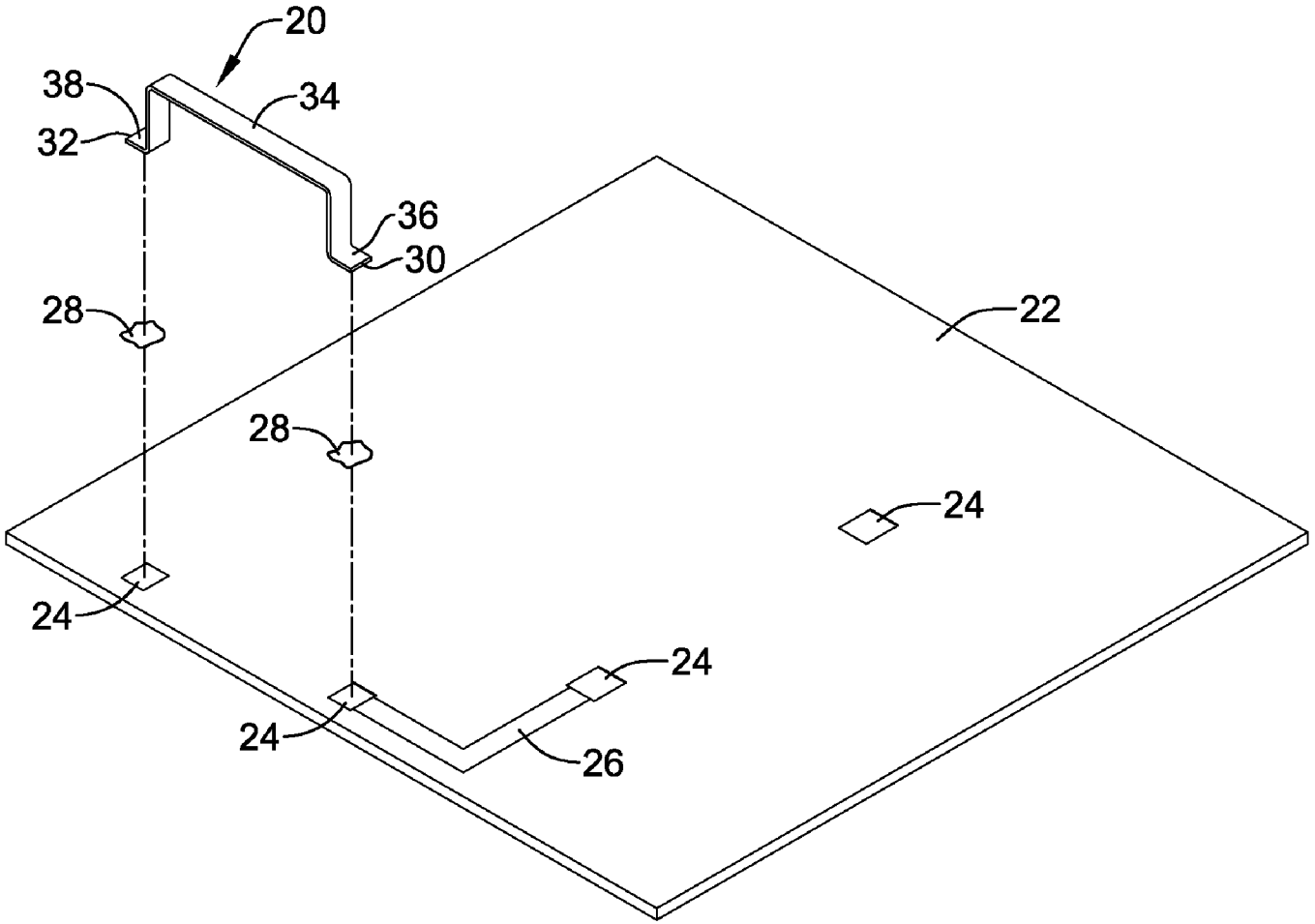
FIG. 7 is an exploded view of the illustrative antenna of FIG. 2 mounted to a printed circuit board.

FIG. 7 is an exploded view of the illustrative antenna 20 of FIG. 2 and a printed circuit board 22 of an HVAC controller. As described above, antenna 20 may include feet 36 and 38 adapted to be mounted to printed circuit board 22. In the illustrative embodiment, printed circuit board 22 may include at least one solder pad 24 and one or more traces 26. The at least one solder pad 24 may be adapted to have a foot 36 and/or 38 of antenna 20 mounted thereon. As illustrated, printed circuit board 22 includes two solder pads 24, one for mounting foot 36 and one for mounting foot 38. In some cases, a solder layer 28 may be applied to the feet 36 and 38 and/or solder pad 24 to facilitate mounting of the antenna 20 to the printed circuit board 22. It is contemplated that feet 36 and 38 may be soldered to their respective solder pads 24 using solder paste 28.

The one or more traces 26 of printed circuit board 22 may electrically connect one or more components (not shown) mounted on the printed circuit board to the antenna 20. In the illustrative embodiment, traces 26 may electrically connect antenna 20 to, for example, a wireless interface (not shown) of the HVAC controller. In some cases, antenna 20 may be connected in series to one or more other antennas (not shown) via traces 26. As illustrated, trace 26 extends from a first solder pad 24 of antenna 20 to another solder pad 24 for receiving another antenna or other device or component. As illustrated, trace 26 connects antenna 20 to another antenna at a 90 degree angle. In other cases, trace 26 may connect antenna 20 to one or more antennas at 0 degrees, 90 degrees, or any angle therebetween. However, it is contemplated that any number of traces 26 may be used to electrically connect antenna 20 to a wireless interface, a second antenna, or any other suitable component on the printed circuit board, as desired. Also, although not depicted in FIG. 7, one or more additional solder pads may be provided to facilitate mounting of an antenna with one or more downward extending intermediate portions, such as antenna 40 and 48 shown in FIGS. 5 and 6, respectively, but this is not required.

Figure 8:
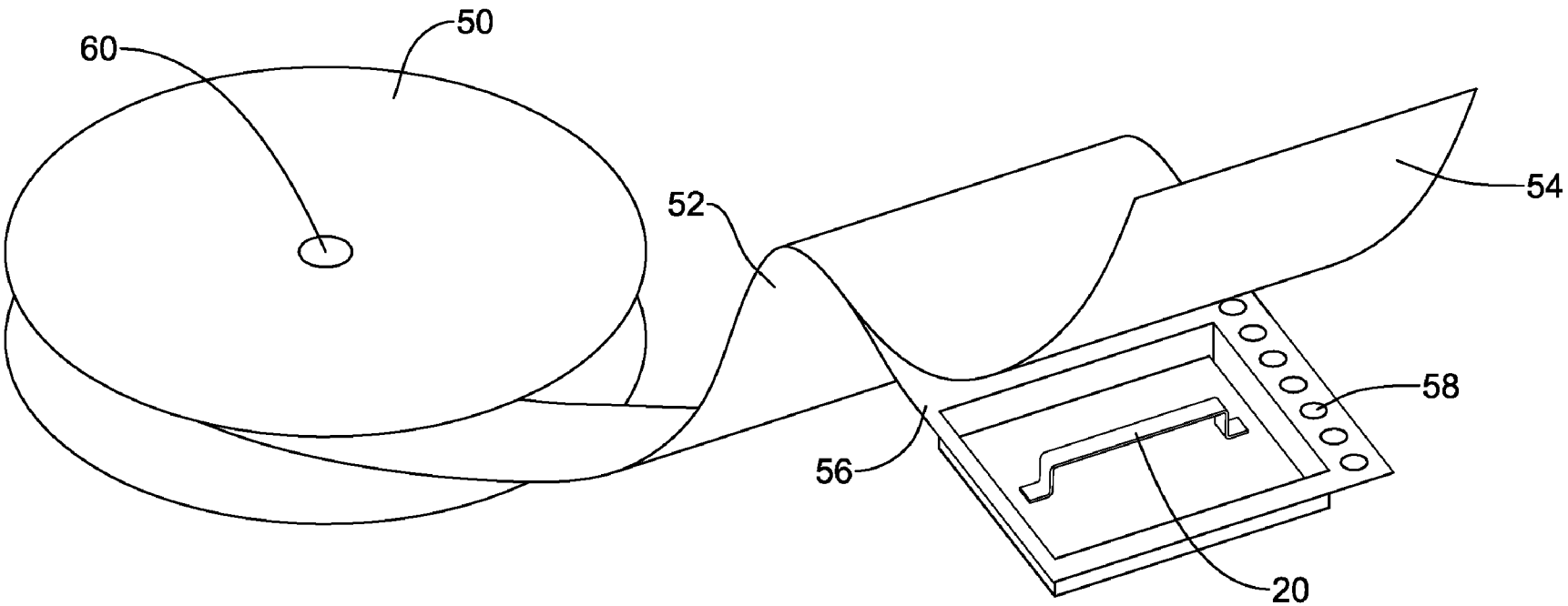
FIG. 8 is a perspective view of an illustrative tape and reel assembly for packaging the illustrative antenna of FIG. 2.

FIG. 8 is a perspective view of an illustrative tape 52 and reel 50 assembly for packaging antenna 20 of FIG. 2 prior to assembly. In the illustrative embodiment, a plurality of antennas 20 are packaged in a tape 52 that is wound onto a reel 50. Tape 52 can include a plurality of cavities or pockets 59 configured to hold a single antenna 20 therein. As illustrated, cavity or pocket 59 may include a bottom surface and four side surfaces with an open top for removing the antenna 20. To help hold the antenna 20 within cavity or pocket 50, tape may include a removable cover 54. In some cases, removable cover 54 may be a thin tape adhesively secured to the tape 52. In one embodiment, the removable cover 54 may be a Mylar sheet. It is contemplated, however, that cover 54 may be made from any suitable material, as desired. As illustrated, the removable cover 54 may be peeled back during the removal of antenna 20 from the tape 52. In the illustrative embodiment, tape 52 may also include a plurality of sprocket holes 58 to facilitate the feeding of the tape 52 into an antenna removal apparatus, such as, for example, a pick-and-place machine, which will be discussed further with reference to FIG. 9 below.

Tape 52, including the plurality of antennas 20, can be wound onto reel 50. In the illustrative embodiment, reel 50 may include an arbor hole 60 located in the center of the reel 50 for mounting reel 50 to the antenna removal apparatus, such as, for example, the pick-and-place machine, used in surface mount technology (SMT). Although not shown, reel 50 may also include one or more labels that specify certain specifications for antenna 20. This may help an operator match and select a correct reel in a production line process.

The illustrative tape 52 and reel 50 have been described with reference to antenna 20, however, it is to be understood that antennas 40 and 48, or any other suitable antenna, may be used, as desired. Additionally, it is to be understood that the foregoing tape 52 and reel 50 are merely illustrative and not meant to be limiting in any manner. It is contemplated that any suitable tape and reel may be used, as desired. Furthermore, it is contemplated that the illustrative antenna may be packaged in any other suitable manner, including, but not limited to, trays or other bulk packaging suitable for mounting.

Figure 9:
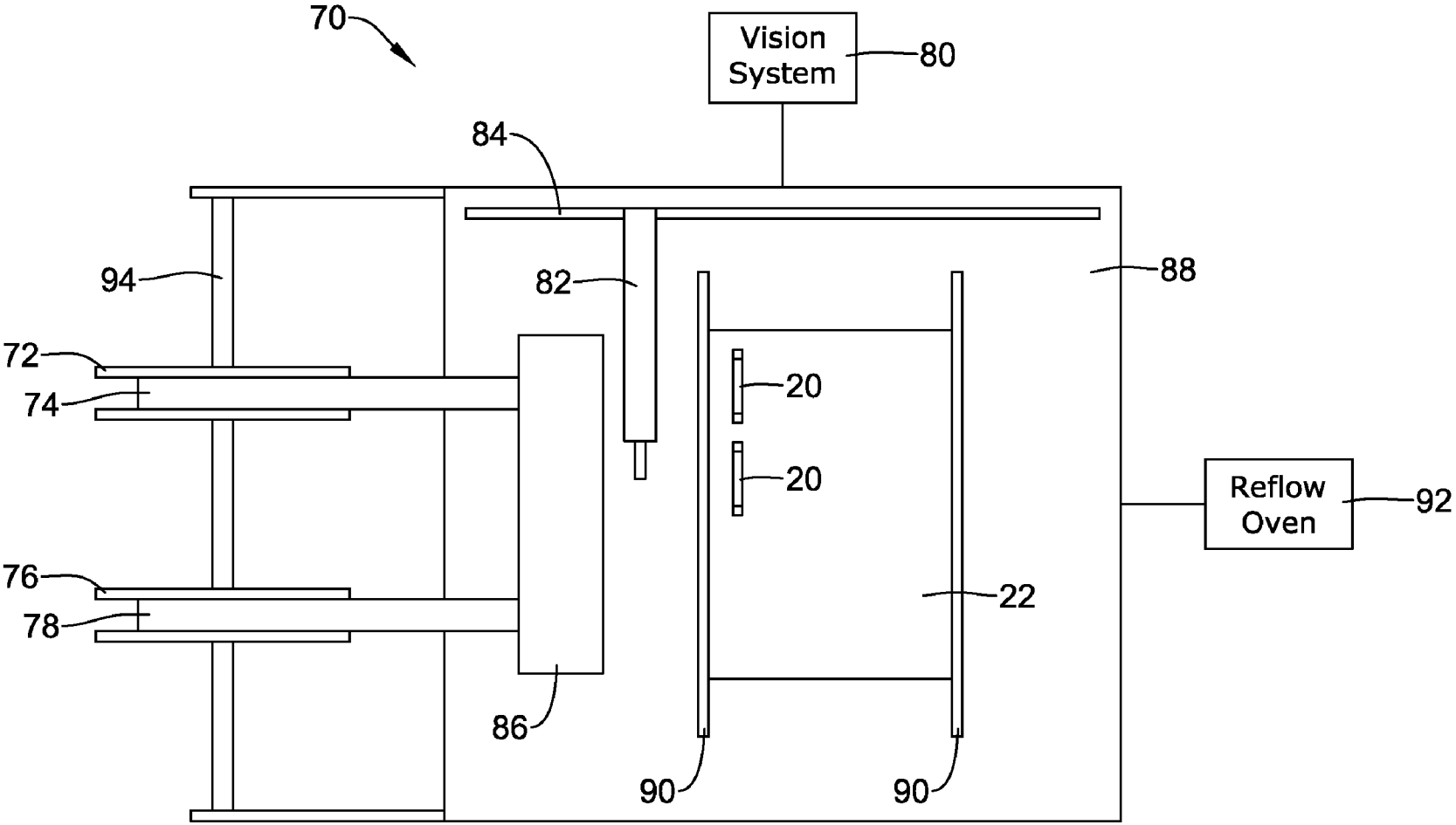
FIG. 9 is a schematic diagram of an illustrative pick-and-place system for surface mounting the antenna from the tape and reel assembly of FIG. 8.

FIG. 9 is a schematic diagram of an illustrative pick-and-place system 70 for mounting antenna 20 using SMT. In the illustrative embodiment, the pick-and-place system 70 may include a picking portion 86 and a placing portion. In some cases, the pick-and-place system 70 may include a table or workstation 88 for holding the picking portion 86 and the placing portion. As illustrated, the table or workstation 88 may include a cassette or feeder 94 configured to hold a plurality of reels 72 and 76 thereon. In some cases, cassette or feeder 94 may be adapted to pass through the arbor hole in reels 72 and 76 to secure the reels 72 and 76 thereto, but yet allow rotation for unwinding of the tape 74 and 78 from reels 72 and 76. In some cases, reel 72 may include tape 74 having antennas of a first length, and reel 76 may include tape 78 having antennas of a second length.

The illustrative picking portion 86 may select a desired antenna 20 from the plurality of reels 72 and 76, if provided. In some cases, the picking portion 86 may index back and forth among the different reels 72 and 76. The picking portion 86 can unwind the tape 74 and 78 from the reels 72 and 76, respectively, as the individual antennas are used. In some cases, picking portion 86 can include a sprocket (not shown) to interact with the sprocket holes of reels 72 and 76 to facilitate the unwinding of reels 72 and 76. Once unwound, picking portion 86 may remove the tape cover (i.e. peel the cover back) and remove the antenna 20 from the tape 74 and 78 cavity. In some cases, the picking portion 86 may include a vacuum pickup to lift the antenna 20 from the cavity. The picking portion 86 may also be configured to cut off the used portion of the tape, if desired.

Placing portion, which may include an arm 82 adapted to translate along a rail 84, may move the selected antenna 20 over a printed circuit board 22 for mounting. The arm 82 of the placing portion holding the antenna 20 may be moved to align the selected antenna 20 with a desired location on the printed circuit board 22. In one case, the arm 82 of the placing portion may translate a first direction along rail 84, and the printed circuit board 22 may translate along a second rail 90 in a second direction, the second direction being perpendicular to the first direction to align the antenna 20 to the desired location on the printed circuit board 22. However, it is contemplated that any suitable movement of the arm 82 may be used relative to the printed circuit board 22, as desired.

In some cases, a vision system 80 may be provided to help orient and/or align the antenna 20 to the printed circuit board 22. In some cases, vision system 80 may automatically align the antenna 20 to the solder pads (not shown) of the printed circuit board 22 or, in other cases, vision system 80 may provide a magnified display for manual alignment of the antenna 20 and the solder pads of the printed circuit board 22. Once aligned, placing portion may apply solder paste (not shown) between antenna 20 and printed circuit board 22. However, in other embodiments, the solder paste may be applied to the solder pads of the printed circuit board 22 prior to entering the pick-and place-system 70. In some embodiments, a paste printing operation may be included in the pick-and-place system 70 to apply solder paste to the printed circuit board 22, if desired. Then, antenna 20 may be pressed into the solder paste.

In some cases, the antenna 20, after surface mounted to the printed circuit board 22, may be placed in a reflow oven 92 to melt and then solidify the solder paste to rigidly attach the antenna 20 to the solder pads of the printed circuit board 22. In one example, the temperature of the reflow oven 92 may be about 430 degrees Fahrenheit. However, any suitable temperature may be used depending on the solder paste and other components on the printed circuit board. For example, a non-lead based solder paste may require a higher temperature than a lead based solder paste. Also, some of the components on the circuit board may be temperature sensitive, thereby requiring that the solder reflow be performed at a lower temperature.

It is to be understood that the foregoing pick-and-place system 70 is merely illustrative and is not meant to be limiting in any manner. It is also to be understood that any pick-and-place system or any suitable surface or other mounting technology may be used to mount the illustrative antennas to a printed circuit board or other substrate, as desired. In one example, it is contemplated that the antennas 20 may be provided in a tray for use in the pick-and-place system 70 instead of the tape and reel, if desired.

Figure 10:
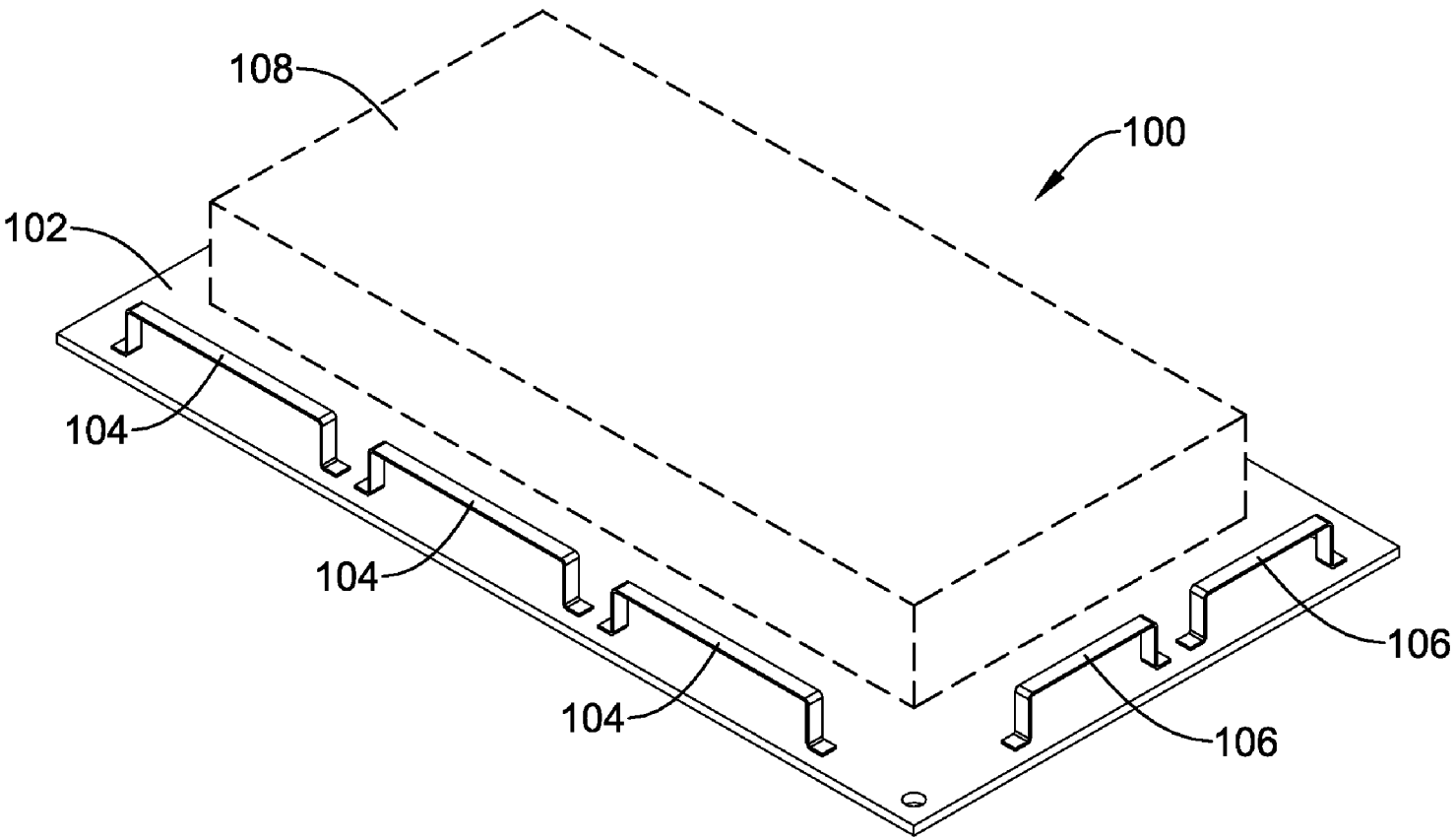
FIGS. 10-15 are perspective views of illustrative HVAC controllers including one or more illustrative antennas.

FIGS. 10-15 are perspective views of illustrative HVAC controllers including one or more illustrative antennas. FIG. 10 is a perspective view of an illustrative HVAC controller 100. The illustrative HVAC controller 100 includes a plurality of components, shown schematically as block 108, mounted to a printed circuit board 102. In this embodiment, two sets of antennas 104 and 106 are mounted to the printed circuit board 102. Antennas 104 are positioned along a first edge of printed circuit board 102. In this case, three antennas 104 are illustrated. Antennas 106, which are relatively shorter than antennas 104, are positioned along a second edge of printed circuit board 102. Although not expressly shown in FIG. 10, one or more traces may be provided for electrically connecting antennas 104 and antennas 106 with one or more components 108 on the printed circuit board.

Figure 11:
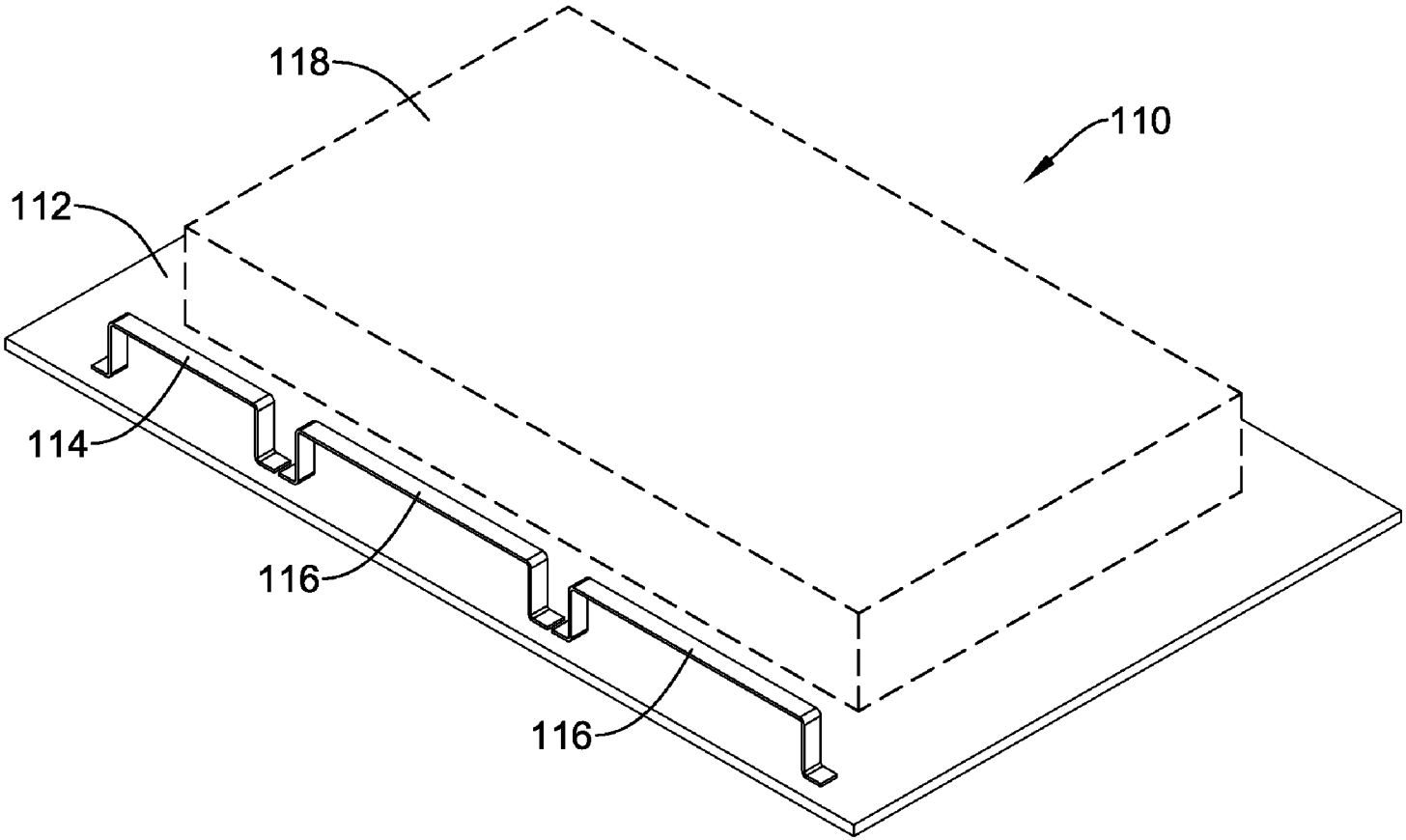

FIG. 11 is a perspective view of another illustrative HVAC controller 110. The illustrative HVAC controller 110 includes a plurality of components 118 mounted to a printed circuit board 112. In this embodiment, antennas 114 and 116 are mounted adjacent to a first edge of printed circuit board 112. As illustrated, antenna 114 is relatively shorter in length than antennas 116. Although not expressly shown in FIG. 11, one or more traces may be provided for electrically connecting antenna 114 and antennas 116 with one or more components 118 on the printed circuit board. In some cases, antenna 114 may be provided as a separate antenna from antennas 116, or may be provided in series or parallel with one or both of antennas 116.

Figure 12:
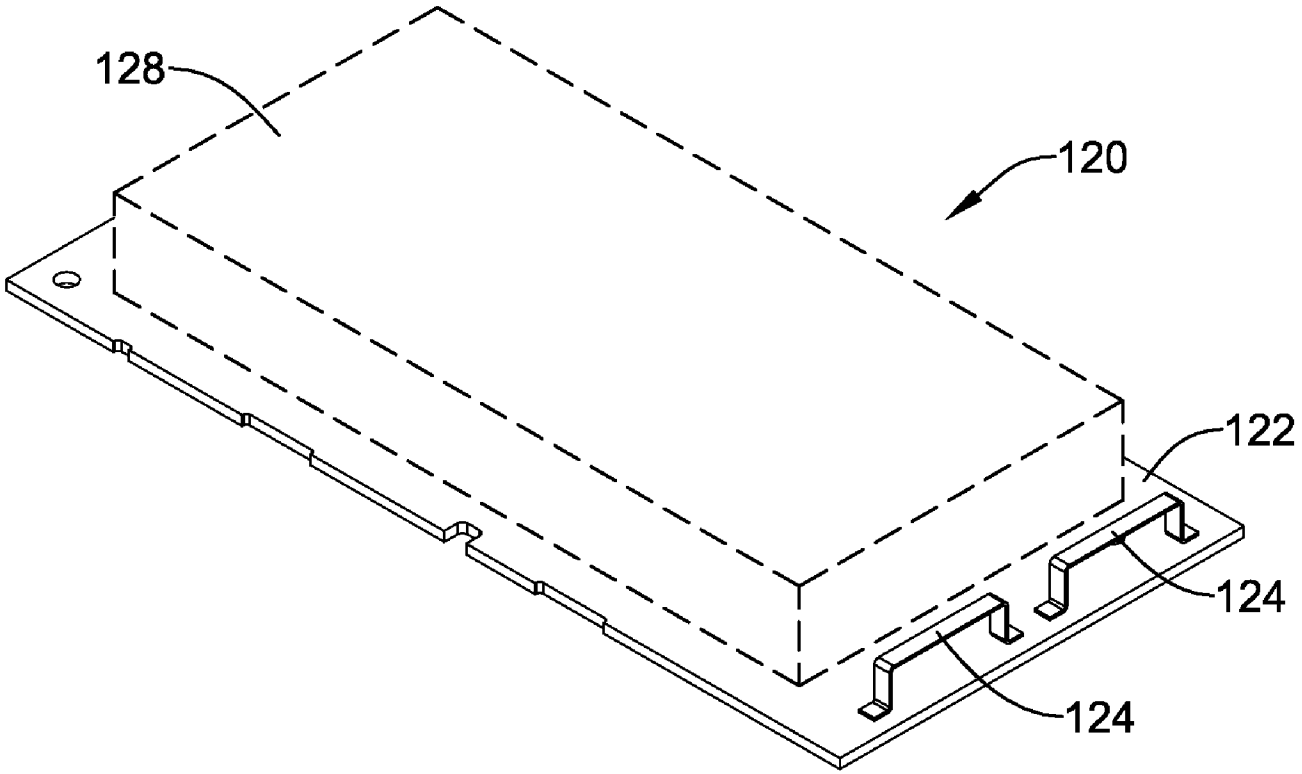

FIG. 12 is a perspective view of another illustrative HVAC controller 120. The illustrative HVAC controller 120 includes a plurality of components 128 mounted to a printed circuit board 122. In this embodiment, a set of two antennas 124 are mounted adjacent to an edge of printed circuit board 122. Although not expressly shown in FIG. 12, one or more traces may be provided for electrically connecting antennas 124 to one or more components 128 on the printed circuit board. In some cases, antennas 124 may be provided as separate antennas, or may be connected in series or parallel, as desired.

Figure 13:
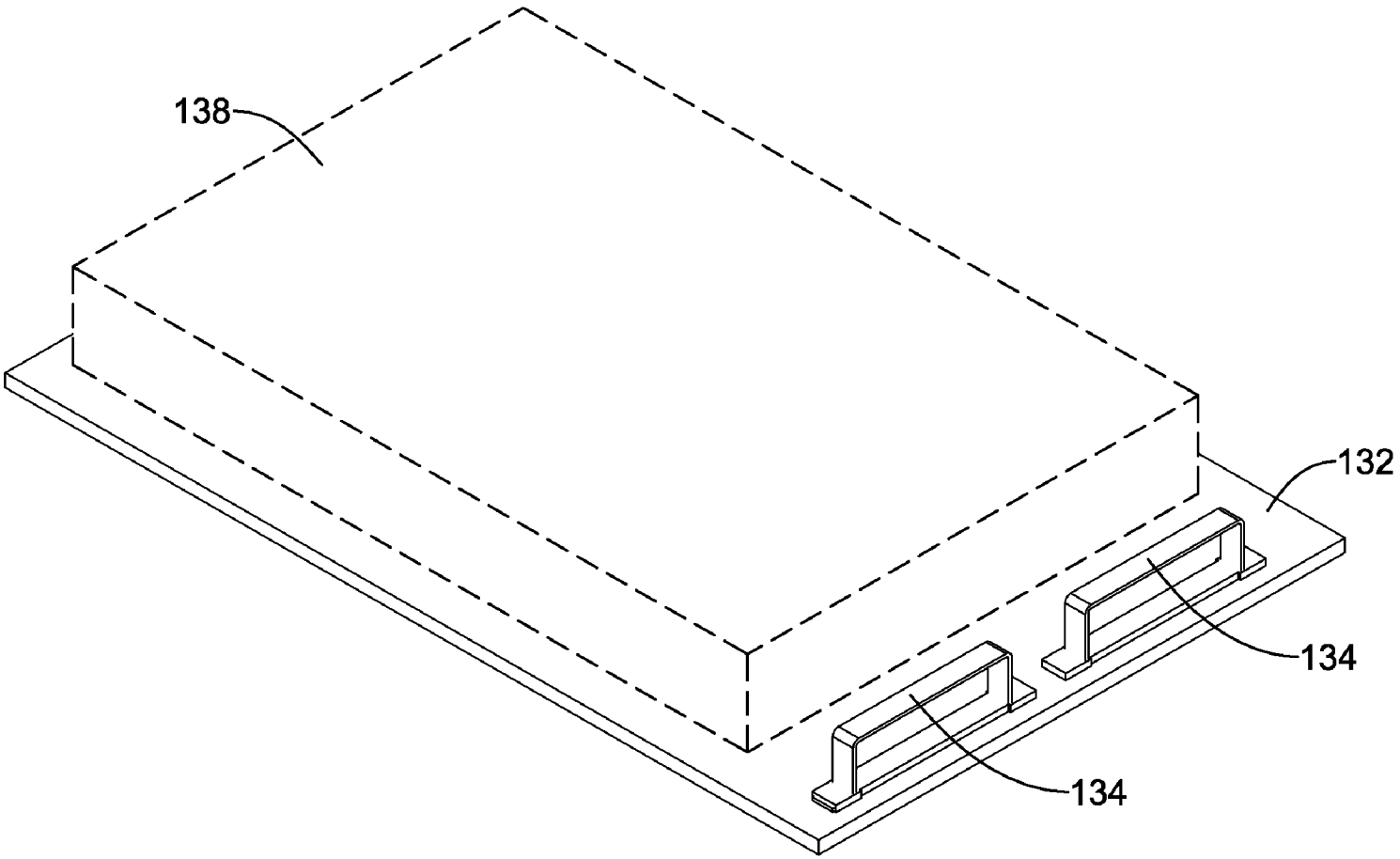

FIG. 13 is a perspective view of another illustrative HVAC controller 130. The illustrative HVAC controller 130 includes a plurality of components 138 mounted to a printed circuit board 132. In this embodiment, two antennas 134 are mounted adjacent to an edge of printed circuit board 132. Although not expressly shown in FIG. 13, one or more traces may be provided electrically connecting antennas 134 with one or more components 138 on the printed circuit board. In the illustrative embodiment, antennas 134 may be provided as separate antennas, or in series or parallel with each other, as desired.

In FIG. 13, the antennas 134 each include a portion adjacent to the printed circuit board 132 connecting the feet. In some cases, this connecting portion may be a non-conductive material. However, it is also contemplated, that in some cases, the connecting portion may be conductive, if desired.

Figure 14:
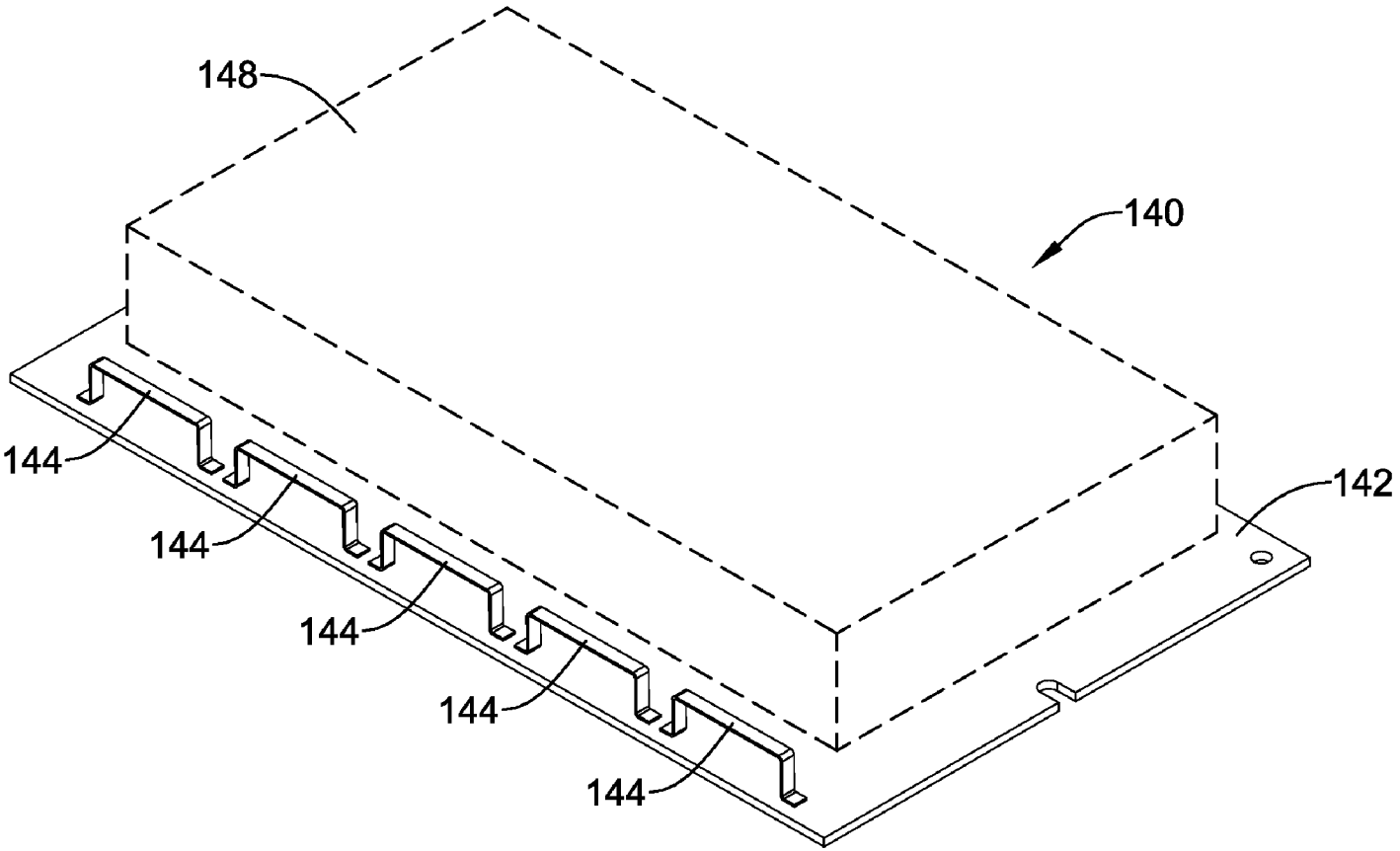

FIG. 14 is a perspective view of another illustrative HVAC controller 140. The illustrative HVAC controller 140 includes a plurality of components 148 mounted to a printed circuit board 142. In this embodiment, five antennas 144 are mounted adjacent to an edge of printed circuit board 142. Although not expressly shown in FIG. 14, one or more traces may be provided for electrically connecting the antennas 144 with one or more components 148 on the printed circuit board. It is contemplated that antennas 144 may be provided as separate antennas, or may be connected in series and/or parallel with one another, as desired.

Figure 15:
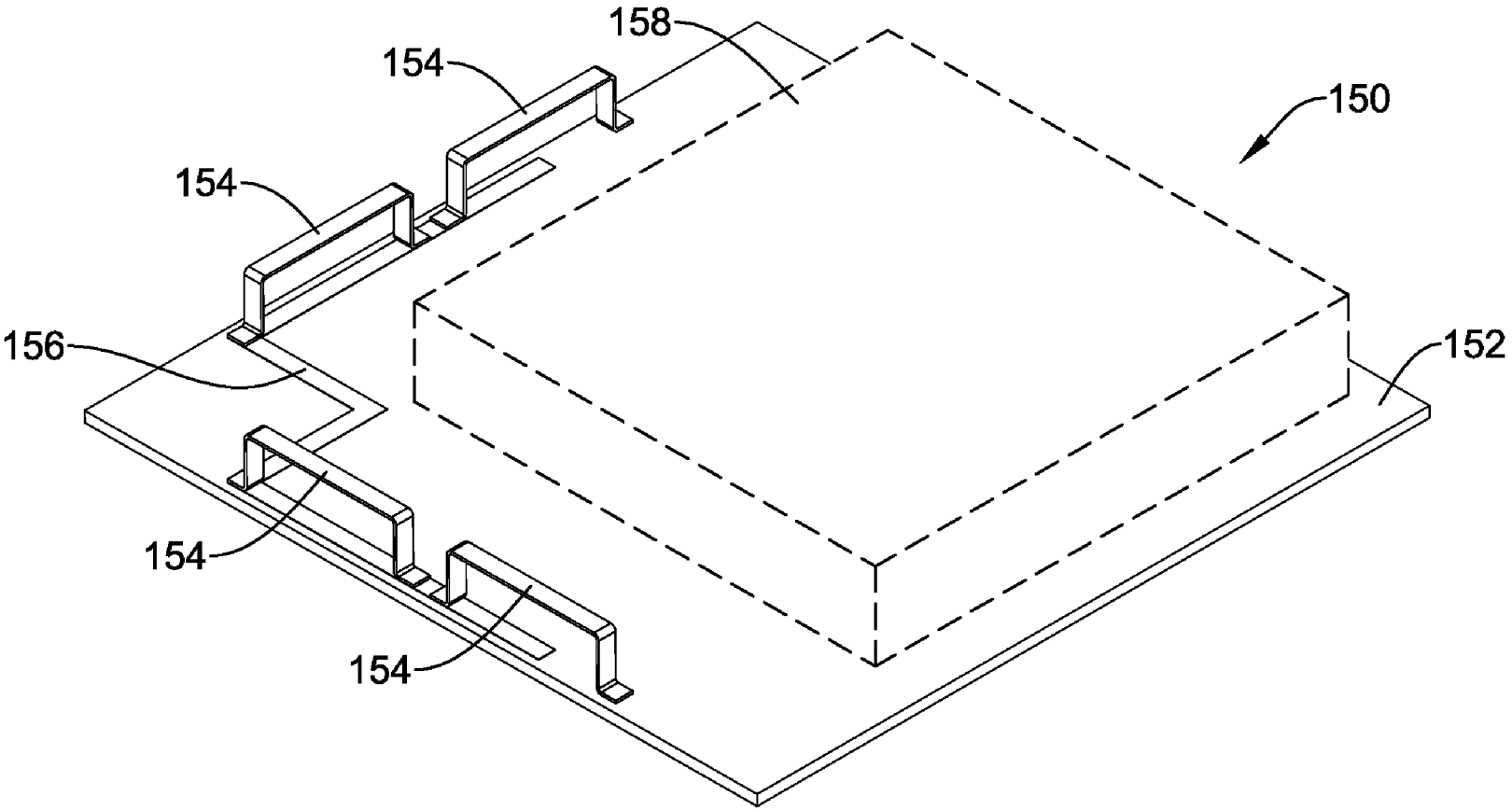

FIG. 15 is a perspective view of another illustrative HVAC controller 150. The illustrative HVAC controller 150 includes a plurality of components 158 mounted to a printed circuit board 152. In this embodiment, a set of two antennas 154 are mounted adjacent to a first edge of printed circuit board 152, and a set of two more antennas 154 is mounted adjacent to a second edge of printed circuit board 152. As illustrated, trace 156 electrically connects antennas 154. Although not expressly shown, one or more additional traces may be provided connecting antennas 154 and one or more other components 158 on the printed circuit board. It is contemplated that antennas 154 may be provided as separate antennas, or may be connected in series and/or parallel with one another, as desired.

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respect, only illustrative. Changes may be made in details, particularly in matters of shape, size, and arrangement of parts without exceeding the scope of the invention. The invention's scope is, of course, defined in the language in which the appended claims are expressed.

The invention claimed is:

1. A method of mounting an antenna to a printed circuit board, the method comprising:

providing a printed circuit board that has one or more solder pads;

providing an antenna, the antenna having two end feet portions and a generally u-shaped intermediate portion between the two end feet portions, wherein the generally u-shaped intermediate portion is configured to be spaced from the printed circuit board with free space extending between at least a majority of the intermediate portion and the printed circuit board, further wherein the generally u-shaped intermediate portion includes at least one intermediate foot portion that extends down toward the printed circuit board to be secured to the printed circuit board; and soldering at least one of the two end feet portions and the intermediate foot portion of the antenna to one or more solder pads of the printed circuit board.

2. The method of claim 1 wherein the at least one of the two end feet portions of the antenna are soldered to the one or more solder pads of the printed circuit board using a surface mount technology (SMT) process.

3. The method of claim 1 wherein two or more antennas are provided on a tape, and the tape is placed on a reel, wherein the tape is unwound from the reel such that a pick and place machine can place one of the antennas adjacent the printed circuit board prior to the soldering step.

4. The method of claim 1 wherein two or more antennas are provided, each having at least two end feet portions and a generally u-shaped intermediate portion between the two end feet portions, wherein at least a portion of the generally u-shaped intermediate portion of each antenna is configured to be spaced from the printed circuit board by free space, and wherein at least one of the two end feet portions of each of the two or more antennas are soldered to corresponding solder pads of the printed circuit board.

5. The method of claim 4 wherein a first one of the two or more antennas has a first length and a second one of the two or more antennas has a second length, and wherein the first one of the two or more antennas is provided on a first tape that is placed on a first reel, and the second one of the two or more antennas is provided on a second tape that is placed on a second reel, wherein the first tape and the second tape are unwound from the first and second reels, respectively, such that the first one of the two or more antennas and the second one of the two or more antennas are placed adjacent the printed circuit board prior to the soldering step.

6. The method of claim 3 wherein the pick and place machine:

removes a selected one of the two or more antennas from the tape; and places the selected one of the two or more antennas such that at least one of the two end feet portions of the selected one of the two or more antennas is adjacent the one or more solder pads of the printed circuit board.

7. The method of claim 6 further comprising providing a vision system to align the selected one of the two or more antennas with the printed circuit board.

8. The method of claim 1 further comprising;

mounting one or more controllers to the printed circuit board;

the one or more controllers including a wireless module that is electrically coupled to at least one of the one or more solder pads; and the one or more controllers including a control module for controlling the comfort level of at least a portion of a building or other structure by activating and deactivating one or more HVAC components.

9. A building controller for controlling the HVAC system of a building, comprising:

a printed circuit board;

one or more controllers mounted to the printed circuit board, the one or more controllers including a wireless interface, and a control module for controlling the comfort level of at least a portion of the building by activating and deactivating one or more HVAC components of the HVAC system; and a first antenna and a second antenna, each of the first antenna and second antenna including a first end, a second end, and an intermediate portion, wherein the first end includes a first foot portion mounted to the printed circuit board, the second end includes a second foot portion mounted to the printed circuit board, the intermediate portion includes a first portion that extends from the first foot portion and generally away from the printed circuit board and a second portion that extends from the second foot portion and generally away from the printed circuit board, and wherein at least a portion of the intermediate portion that extends between the first portion and the second portion has a conductive core and is spaced from the printed circuit board by free space along a majority of the intermediate portion that extends between the first portion and the second portion, and wherein the intermediate portion includes at least one intermediate foot portion that extends down toward the printed circuit board to be secured to the printed circuit board;

wherein the first antenna and the second antenna are electrically coupled to the wireless interface for transmitting and/or receiving wireless signals; and wherein the first antenna and the second antenna each have a long dimension, and the first antenna and the second antenna are mounted to the printed circuit board such that their long dimensions are substantially perpendicular.

10. The building controller of claim 9 wherein the building controller is a wall mountable thermostat.

11. The building controller of claim 9 wherein the building controller is a portable remote control unit.

12. The building controller of claim 9 wherein the building controller is a portable remote control unit that is adapted to wirelessly communicate with a wall mountable thermostat.

13. A portable remote control unit for wirelessly communicating with a wall mountable electronic thermostat, comprising:

a printed circuit board;

a temperature sensor mounted to the printed circuit board;

one or more controllers mounted to the printed circuit board, the one or more controllers including a wireless interface; and an antenna including a first end, a second end, and an intermediate portion, wherein the first end includes a first foot portion mounted to the printed circuit board, the second end includes a second foot portion mounted to the printed circuit board, and the intermediate portion includes a conductive core that extends from the first foot portion to the second foot portion and has a generally u-shaped region, wherein a majority of the generally u-shaped region of the intermediate portion is spaced from the printed circuit board by free space but includes at least one intermediate foot portion that extends down toward the printed circuit board to be secured to the printed circuit board;

wherein the antenna is electrically coupled to the wireless interface for transmitting and/or receiving wireless signals with the wall mountable electronic thermostat.

* * * * *